US009306337B2

(12) United States Patent
Yu et al.

(10) Patent No.: US 9,306,337 B2
(45) Date of Patent: Apr. 5, 2016

(54) ELECTRICAL CONNECTOR WITH INNER SHELL IN TWO PIECES

(71) Applicant: ALLTOP ELECTRONICS (SUZHOU) LTD., Taicang (CN)

(72) Inventors: Wang-I Yu, Jhonghe (TW); Li-Li Liang, Jhonghe (TW); Yong-Gang Zhang, Jhonghe (TW); Mao-Jung Huang, Jhonghe (TW); Kun Liu, Jhonghe (TW)

(73) Assignee: ALLTOP ELECTRONICS (SUZHOU) LTD., Taicang (CN)

( * ) Notice: Subject to any disclaimer, the term of this patent is extended or adjusted under 35 U.S.C. 154(b) by 0 days.

(21) Appl. No.: 14/561,366

(22) Filed: Dec. 5, 2014

(65) Prior Publication Data

US 2016/0064870 A1 Mar. 3, 2016

(30) Foreign Application Priority Data

Sep. 3, 2014 (CN) ..... 2014 1 0445044

(51) Int. Cl.

| | |
|---|---|
| ***H01R 13/648*** | (2006.01) |
| ***H01R 13/6585*** | (2011.01) |
| ***H01R 13/6597*** | (2011.01) |
| ***H01R 24/60*** | (2011.01) |
| *H01R 107/00* | (2006.01) |

(52) U.S. Cl.

CPC ..... *H01R 13/6585* (2013.01); *H01R 13/6597* (2013.01); *H01R 24/60* (2013.01); *H01R 2107/00* (2013.01)

(58) Field of Classification Search

CPC ..... H01R 13/65802; H01R 13/658; H01R 23/6873; H01R 13/506; H01R 23/7073

USPC ..... 439/497, 607.27, 607.4, 607.25, 607.55

See application file for complete search history.

(56) References Cited

U.S. PATENT DOCUMENTS

| | | | | |
|---|---|---|---|---|
| 8,535,097 | B2 * | 9/2013 | Yen | H01R 12/724 439/607.27 |
| 8,790,138 | B2 * | 7/2014 | Wang | H01R 27/02 439/607.4 |
| 8,882,540 | B2 * | 11/2014 | Yen | H01R 27/00 439/489 |
| 9,011,178 | B2 * | 4/2015 | Hori | H01R 13/6581 29/842 |
| 9,093,784 | B2 * | 7/2015 | Zhang | H01R 13/6272 |
| 9,209,573 | B1 * | 12/2015 | Chen | H01R 13/6581 |

* cited by examiner

*Primary Examiner* — Phuong Dinh
(74) *Attorney, Agent, or Firm* — Sughrue Mion, PLLC

(57) ABSTRACT

An electrical connector includes an insulative housing, a number of contacts retained in the insulative housing, a metallic outer shell enclosing the insulative housing, and a metallic inner shell positioned between the metallic outer shell and the insulative housing. The insulative housing includes a base and a tongue portion protruding from the base. The contacts include a number of flat contacting portions exposed on a top surface and a bottom surface of the tongue portion, respectively. The metallic inner shell includes at least two pieces which are separately made and fixed to the insulative housing. The metallic inner shell and the metallic outer shell are in mechanical contact with each other in order to achieve a relative larger grounding area.

20 Claims, 10 Drawing Sheets

ELECTRICAL CONNECTOR WITH INNER SHELL IN TWO PIECES

CROSS REFERENCE TO RELATED APPLICATIONS

The present application claims the priority of Chinese patent application Ser. No. 201410445044.5 filed Sep. 3, 2014 in the SIPO (Sate Intellectual Property Office of the P.R.C.), which is incorporated by reference herein in its entirety.

BACKGROUND

1. Technical Field

The present disclosure relates to an electrical connector, and more particularly to an electrical connector having a metallic inner shell.

2. Description of Related Art

A conventional I/O connector for being mounted to a circuit board usually includes an insulative housing, a plurality of contacts retained in the insulative housing and an outer shell enclosing the insulative housing. The insulative housing usually includes a base and a tongue portion extending from the base. Since the tongue portion is usually thinner than the base, the strength of the tongue portion maybe not strong enough. In order to solve this problem, an inner shell is provided. Usually, such inner shell is of an annular shape through which the insulative housing extends. The inner shell can not only improve the strength of the insulative housing but also realize robust shielding effect. For this reason, it is crucial to fasten the inner shell with the insulative housing.

Nowadays, the inner shell is usually formed by stretch molding technology which requires rigorous moulds and complex structures. Usually, in designing the stretch moulds, in order to easily manufacture the inner shell, the R angle of the punish needs to be designed much larger than the actual dimension. Under this condition, it is difficult to stably fix the inner shell to the insulative housing because its dimension is somehow much bigger. Besides, the inner shell manufactured through the stretch molding technology probably has weak strength and may easily get deformed.

Hence, it is desirable to provide an electrical connector with an improved inner shell.

SUMMARY

The present disclosure provides an electrical connector including an insulative housing, a plurality of contacts retained in the insulative housing, a metallic outer shell enclosing the insulative housing, and a metallic inner shell positioned between the metallic outer shell and the insulative housing. The insulative housing includes a base and a tongue portion protruding from the base. The tongue portion includes a top surface and a bottom surface opposite to the top surface. The contacts include a plurality of flat contacting portions exposed on the top surface and the bottom surface, respectively. The metallic inner shell covers the base of the insulative housing. The metallic inner shell includes at least two pieces which are separately made and fixed to the insulative housing. The metallic inner shell and the metallic outer shell are in mechanical contact with each other in order to achieve a relative larger grounding area.

The foregoing has outlined rather broadly the features and technical advantages of the present disclosure in order that the detailed description of the invention that follows may be better understood. Additional features and advantages of the invention will be described hereinafter which form the subject of the claims of the invention.

BRIEF DESCRIPTION OF THE DRAWINGS

The components in the drawing are not necessarily drawn to scale, the emphasis instead being placed upon clearly illustrating the principles of the described embodiments. In the drawings, reference numerals designate corresponding parts throughout various views, and all the views are schematic.

DETAILED DESCRIPTION OF ILLUSTRATED EMBODIMENTS

Figure 1:
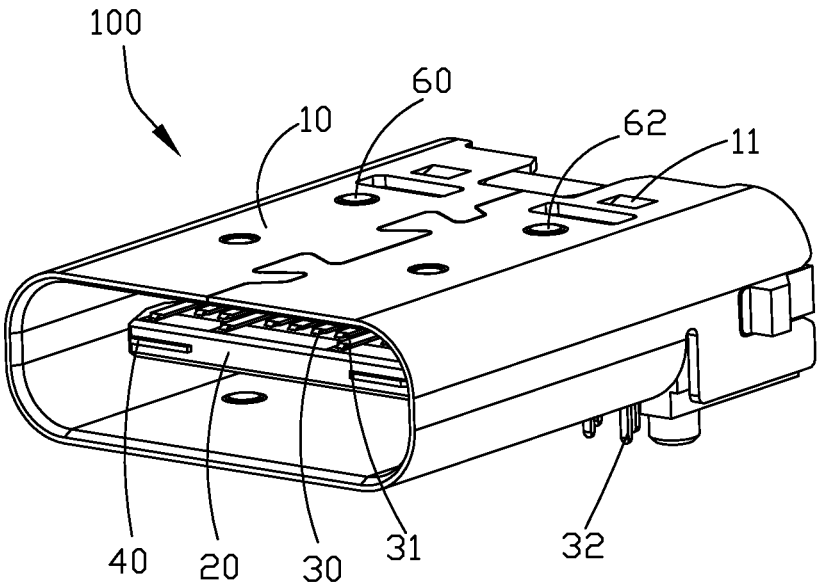
FIG. 1 is a perspective view of an electrical connector in accordance with a first embodiment of the present disclosure.

Reference will now be made to the drawing figures to describe the embodiments of the present disclosure in detail. In the following description, the same drawing reference numerals are used for the same elements in different drawings.

Referring to FIGS. 1 to 3 and 7, the present disclosure discloses an electrical connector 100 capably of being mounted to a circuit board (not shown) for receiving a plug connector (not shown). The electrical connector 100 includes an insulative housing 20, a plurality of contacts 30 retained in the insulative housing 20, a metallic grounding plate 40 embedded in the insulative housing 20, a metallic outer shell 10 enclosing the insulative housing 20, and a metallic inner shell 50 located between the insulative housing 20 and the outer shell 10.

Figure 2:
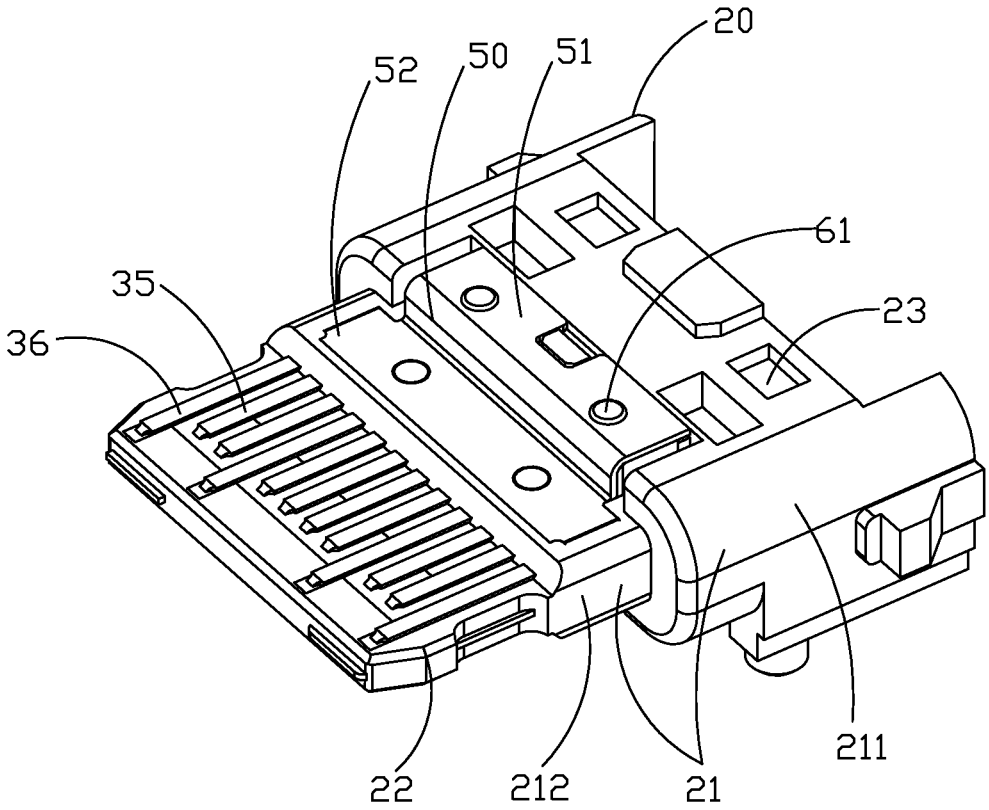
FIG. 2 is a perspective view of the electrical connector as shown in FIG. 1 with an outer shell removed therefrom.
Figure 7:
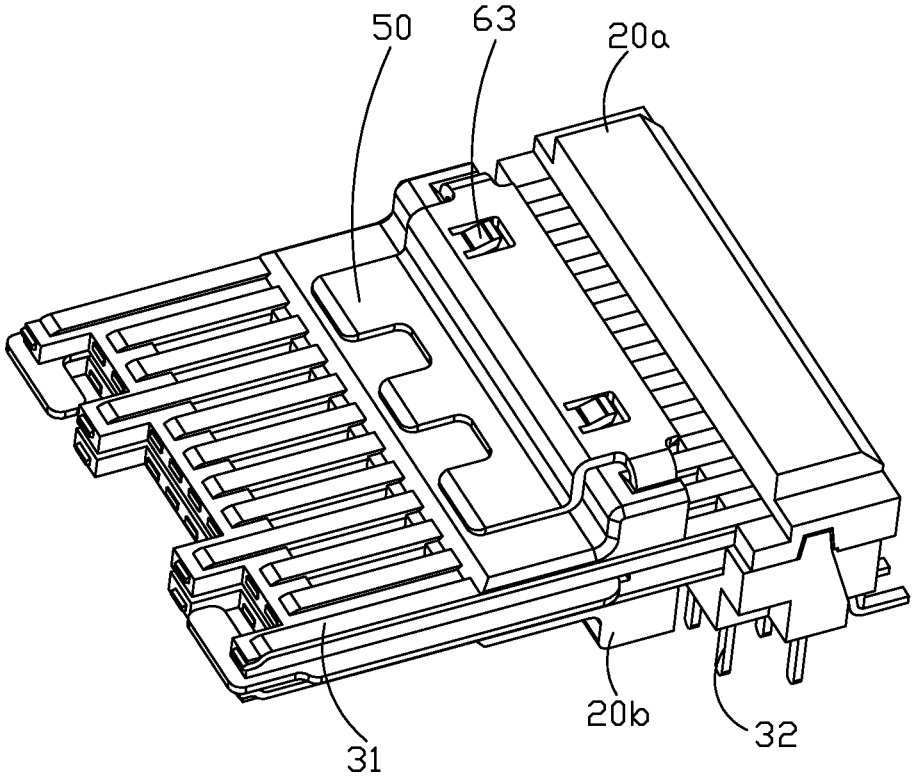
FIG. 7 is a perspective view of an electrical connector in accordance with a second embodiment of the present disclosure with an outer shell removed therefrom.

Referring to FIGS. 2 and 7, the insulative housing 20 includes a base 21 and a tongue portion 22 protruding forwardly from the base 21. The base 21 includes a rear portion 211 and a front portion 212. The tongue portion 22 extends from the front portion 212. As clearly shown in FIG. 2, the thickness of the rear portion 211, the front portion 212 and the tongue portion 22 is gradually reduced. In other words, the tongue portion 22, the front portion 212 and the rear portion are of stepped manners. Under this condition, since the front portion 212 and the tongue portion 22 is not thick enough, it is necessary to reinforce them, which will be described hereinafter.

Referring to FIGS. 2, 3, 7 and 8, each contact 30 includes a contacting portion 31 extending to the tongue portion 22 and a soldering portion 32 for being mounted to the circuit board. It is easily understandable to those of ordinary skill in the art that the contacts 30 can either be assembled to or be insert molded with the insulative housing 20. The contacts 30 include a group of upper contacts 30*a* and a group of lower contacts 30*b*. Referring to FIG. 2, the contacting portions 31 of the upper contacts 30*a* and the lower contacts 30*b* are exposed on a top surface and a bottom surface of the tongue portion 22, respectively. According to the illustrated embodiment of the present disclosure, the insulative housing 20 includes an upper insulative housing 20*a* inject-molded with the upper contacts 30*a*, a lower insulative housing 20*b* inject-molded with the lower contacts 30*b*, and an outer insulative housing 20*c* inject-molded on the upper insulative housing 20*a* and the lower insulative housing 20*b*. As a result, the strength of the insulative housing 20 can be improved and the contacts 30 can be stably held in the insulative housing 20 as well.

Figure 3:
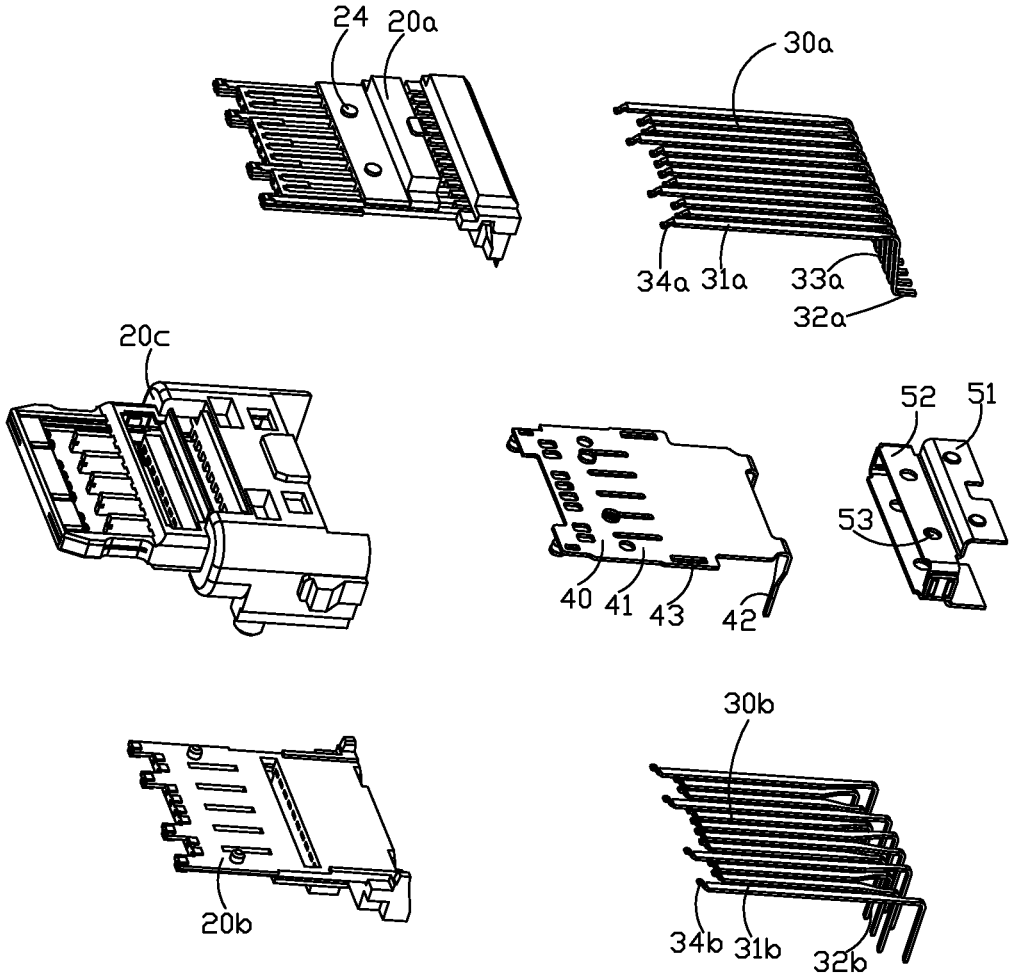
FIG. 3 is an exploded view of the electrical connector shown in FIG. 2.

Referring to FIG. 3, the upper contacts 30*a* are arranged in a side-by-side manner. Each upper contact 30*a* includes an upper contacting portion 31*a*, a slant portion 33*a* extending slantwise from the upper contacting portion 31*a* and an upper soldering portion 32*a* extending from the slant portion 33*a*. Besides, each upper contacting portion 31*a* includes an upper protrusion 34*a* bent downwardly from a front end thereof. The upper protrusions 34*a* are embedded in the upper insulative housing 20*a* for fixation when the upper insulative housing 20*a* is inject-molded with the upper contacts 30*a*. The upper soldering portions 32*a* are so-called SMT types and are arranged in a single row for being easily soldered onto the circuit board.

Each lower contact 30*b* includes a lower contacting portion 31*b* and a lower soldering portion 32*b* extending downwardly from the lower contacting portion 31*b*. Similar to the upper protrusions 34*a*, each lower contacting portion 31*b* includes a lower protrusion 34*b* bent upwardly from a front end thereof. The lower protrusions 34*b* are embedded in the lower insulative housing 20*b* for fixation as well. The lower soldering portions 32*b* are so-called Through Hole types and are arranged in two rows for being soldered through the circuit board. Of course, the arrangement of the upper soldering portions 32*a* and the lower soldering portions 32*b* can be designed in other types according to different requirements. For example, the lower soldering portions 32*b* can also be arranged in a single row and/or the lower soldering portions 32*b* can also be designed in SMT types.

Both the upper contacts 30*a* and the lower contacts 30*b* include a plurality of first contacts 35 for transmitting signal or power (also known as signal contacts or power contacts, respectively), and a plurality of second contacts 36 for grounding (also known as ground contacts). In a single row, the first contacts 35 are located between the second contacts 36. Among the upper contacts 30*a* and the lower contacts 30*b*, at least some the second contacts 36 are located at opposite lateral sides for being easily connected to the outer shell 10 or the inner shell 50. Under this design, the grounding area can be enlarged so that the signal interference can be reduced. In a single row, according to the illustrated embodiment of the present disclosure, the first contacts 35 include three pairs of differential signal contacts and some power contacts. According to the illustrated embodiment of the present disclosure, the contacting portions 31 of the upper contacts 30*a* and the contacting portions 31 of the lower contacts 30*b* are of the same type while in a reversed arrangement in order that the plug connector can be inserted into the electrical connector 100 either in a normal insertion or in a reverse insertion.

Figure 4:
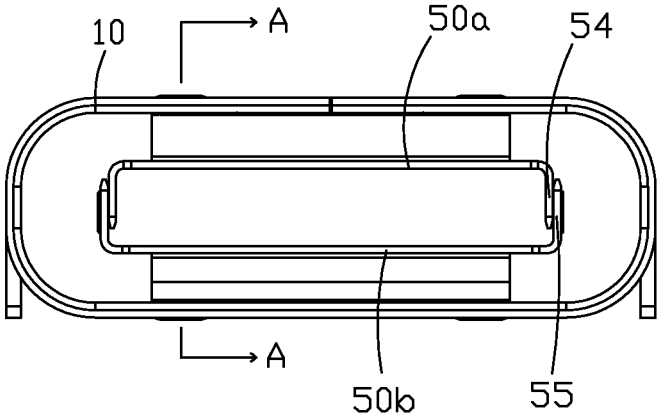
FIG. 4 is a front view showing the relationship of the outer shell and an inner shell.

Referring to FIGS. 1, 4 and 7, the outer shell 10 defines a receiving opening to accommodate the tongue portion 22. The tongue portion 22 is located at a center of the outer shell 10 along a vertical direction in order to realize that the plug connector can be inserted into the electrical connector 100 either in the normal insertion or in the reverse insertion. It is understandable that, in order to realize the plug connector can be inserted into the electrical connector 100 either in the normal insertion or in the reverse insertion, the distance between a top side of the tongue portion 22 and a top wall of the outer shell 10 is the same as the distance between a bottom side of the tongue portion 22 and a bottom wall of the outer shell 10.

Figure 5:
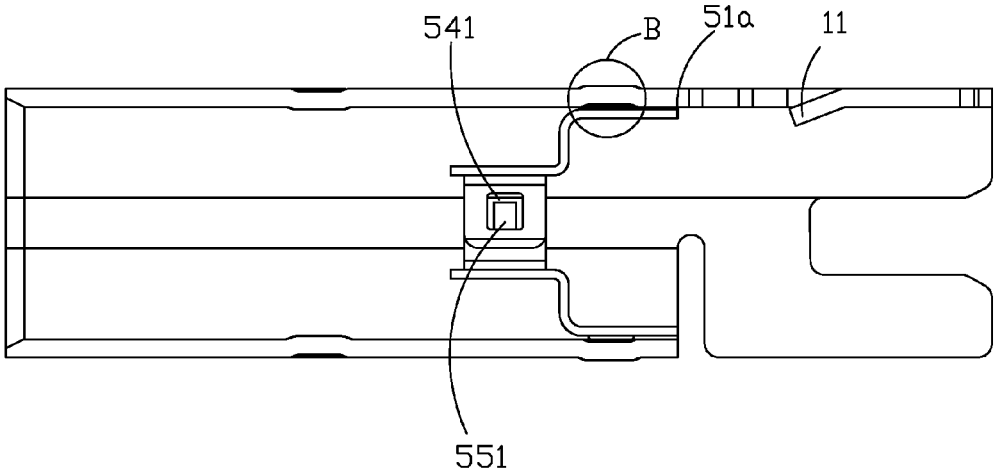
FIG. 5 is a schematic cross-sectional view taken along line A-A of FIG. 4.

Referring to FIG. 5, the outer shell 10 includes a tab 11 stamped from a top wall thereof and the insulative housing 20 defines a top recess 23 to receive the tab 11 so that the outer shell 10 can be fixed to the insulative housing 20. Besides, the present disclose further includes a second outer shell (not shown) enclosing the outer shell 10. The structure of the second outer shell and the outer shell 10 are complementary with each other in order to improve the shielding effect and strength. Moreover, the second outer shell includes mounting legs fixed to the circuit board for grounding purpose and improving shielding effect.

Referring to FIGS. 2, 3, 7 and 8, the inner shell 50 is mounted to the base 21 of the insulative housing 20. For one hand, the inner shell 50 can help to improve the strength of the insulative housing 20. For the other hand, the inner shell 50 can also improve some shielding function. The inner shell 50 includes a first part 51 for mating with the rear portion 211 and a second part 52 for mating with the front portion 212. The first part 51 and the second part 52 are in a stepped configuration.

Referring to FIGS. 1 to 3, one of the inner shell 50 and the insulative housing 20 includes a fixing protrusion 24, and a remaining one of the inner shell 50 and the insulative housing 20 includes a fixing opening 53 to receive the fixing protrusion 24. According to the illustrated embodiment of the present disclosure, the fixing protrusion 24 includes a pair of cylinder posts formed on the front portion 212. The fixing opening 53 is formed on the second part 52 for receiving the cylinder posts. As a result, the inner shell 50 and the insulative housing 20 can be combined together.

Referring to FIGS. 3 to 5, the inner shell 50 includes a top shell 50*a* and a bottom shell 50*b*. The top shell 50*a* and the bottom shell 50*b* are separately made and assembled together. The top shell 50*a* is attached to a top side of the insulative housing 20 and the bottom shell 50*b* is attached to a bottom side of the insulative housing 20. One of the top shell 50*a* and the bottom shell 50*b* includes a hook 551, and a remaining one of the top shell 50*a* and the bottom shell 50*b* includes a slot 541 to receive the hook 551 so that the top shell 50*a* and the bottom shell 50*b* can be locked together. According to the illustrated embodiment of the present disclosure, the top shell 50*a* includes a pair of top sidewalls 54 extending downwardly and the bottom shell 50*b* includes a pair of bottom sidewalls 55 extending upwardly. One of the hook 551 and the slot 541 is formed on the top sidewall 54 and a remaining one of the hook 551 and the slot 541 is formed on the bottom sidewall 55. After completing assembly of the top shell 50*a* and the bottom shell 50*b*, the top sidewalls 54 and the bottom sidewalls 55 are jointed with each other so as to form a frame. The insulative housing 20 extends through the frame.

According to the illustrated embodiment of the present disclosure, the top shell 50*a* and the bottom shell 50*b* are separately molded for reducing cost and easy manufacture. Besides, it is easy to inject mold the outer insulative housing 20*c* after mounting the top shell 50*a* and the bottom shell 50*b* to the upper insulative housing 20*a* and the lower insulative housing 20*b*, respectively. Besides, according to this design, it is beneficial to avoid insufficient molding or redundant molding.

Referring to FIGS. 1 to 10, the outer shell 10 and the inner shell 50 are in mechanical contact with each other via a connecting member 60 for enlarge grounding area and decreasing signal interference.

Referring to FIGS. 1 to 6, according to the illustrate embodiment of the present disclosure, the connecting member 60 includes a protrusion 61 formed on one of the inner shell 50 and the outer shell 10 and a recess 62 formed on a remaining one of the inner shell 50 and the outer shell 10. The protrusion 61 is received in the recess 62 in order to achieve mechanical contact. The protrusion 61 and the recess 62 can be formed of round shapes or any other shapes capable of realizing the same function.

Figure 6:
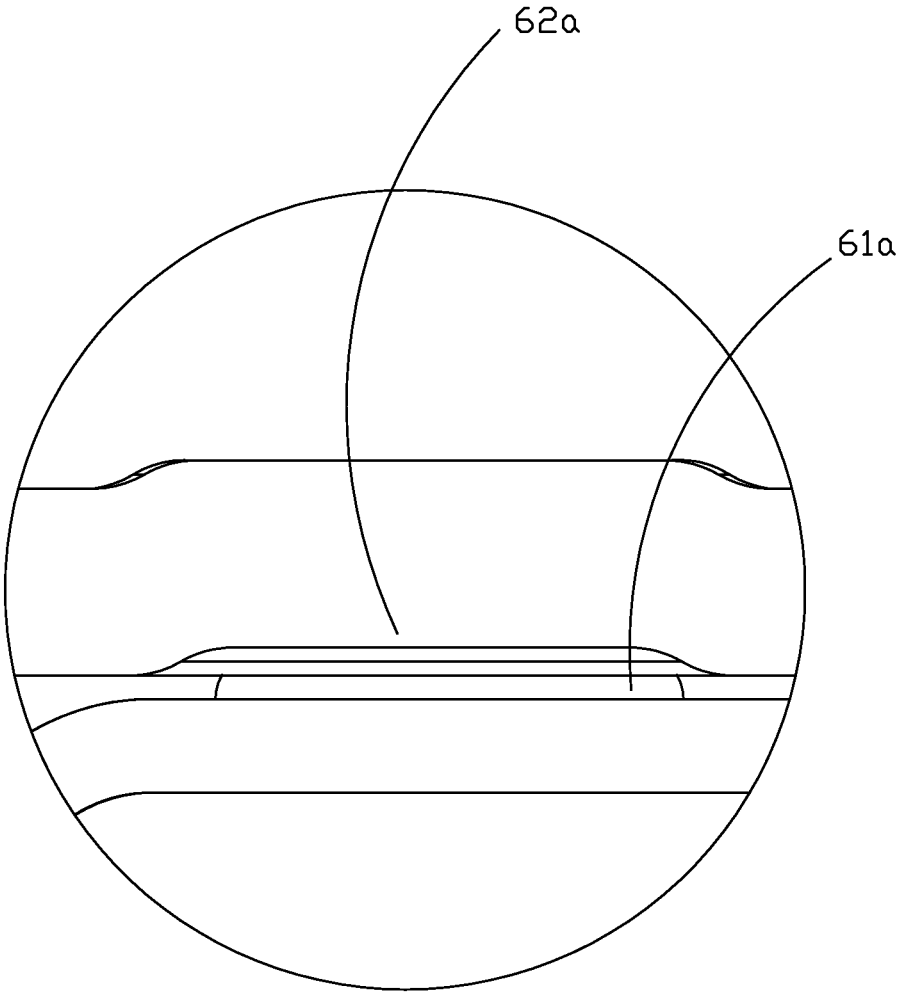
FIG. 6 is a partly enlarged view of a circle B shown in FIG. 5.

Referring to FIGS. 4 and 6, the top shell 50*a* includes a protrusion 61*a* extending upwardly on a first top portion 51*a* and the outer shell 10 includes a recess 62*a* to receive the protrusion 61*a*. The protrusion 61*a* abuts against the recess 62*a* in order to achieve mechanical contact between the top shell 50*a* and the outer shell 10. The structure of the bottom shell 50*b* is symmetrical with the top shell 50*a* so that it will not be depicted in detail herein. Different from the illustrated embodiments, the protrusion 61 can also be formed on the outer shell 10 and the recess 62 can be formed on the top shell 50*a* and/or the bottom shell 50*b*. Besides, the mateable protrusion 61 and the recess 62 can also be formed at lateral sides of the electrical connector 100.

Referring to FIG. 3, the grounding plate 40 is stamped from a metal sheet and located between the upper contacts 30*a* and the lower contacts 30*b*. The grounding plate 40 can either be assembled to the insulative housing 20 or be embedded into the insulative housing 20. The grounding plate 40 can not only reinforce the strength of the insulative housing 20 but also reducing the signal interference between the upper contacts 30*a* and the lower contacts 30*b*. As shown in FIG. 2, the grounding plate 40 extends beyond a front end of the tongue portion 22.

As shown in FIG. 3, the grounding plate 40 includes a flat body 41 and a mounting portion 42 extending downwardly from the body 41. The flat body 41 includes a plurality of through holes 43 through which the top sidewalls 54 and the bottom sidewalls 55 extend. The hook 551 and the slot 541 are mating with each other in the through holes 43. Besides, with the top sidewalls 54 and the bottom sidewalls 55 extending through the grounding plate 40, the mechanical connection of the inner shell 50 and the grounding plate 40 is established. As a result, the inner shell 50, the grounding plate 40 and the outer shell 10 are in series contact with each other in order to realize a relative larger grounding area. Therefore, the signal interference can be greatly decreased.

Figure 8:
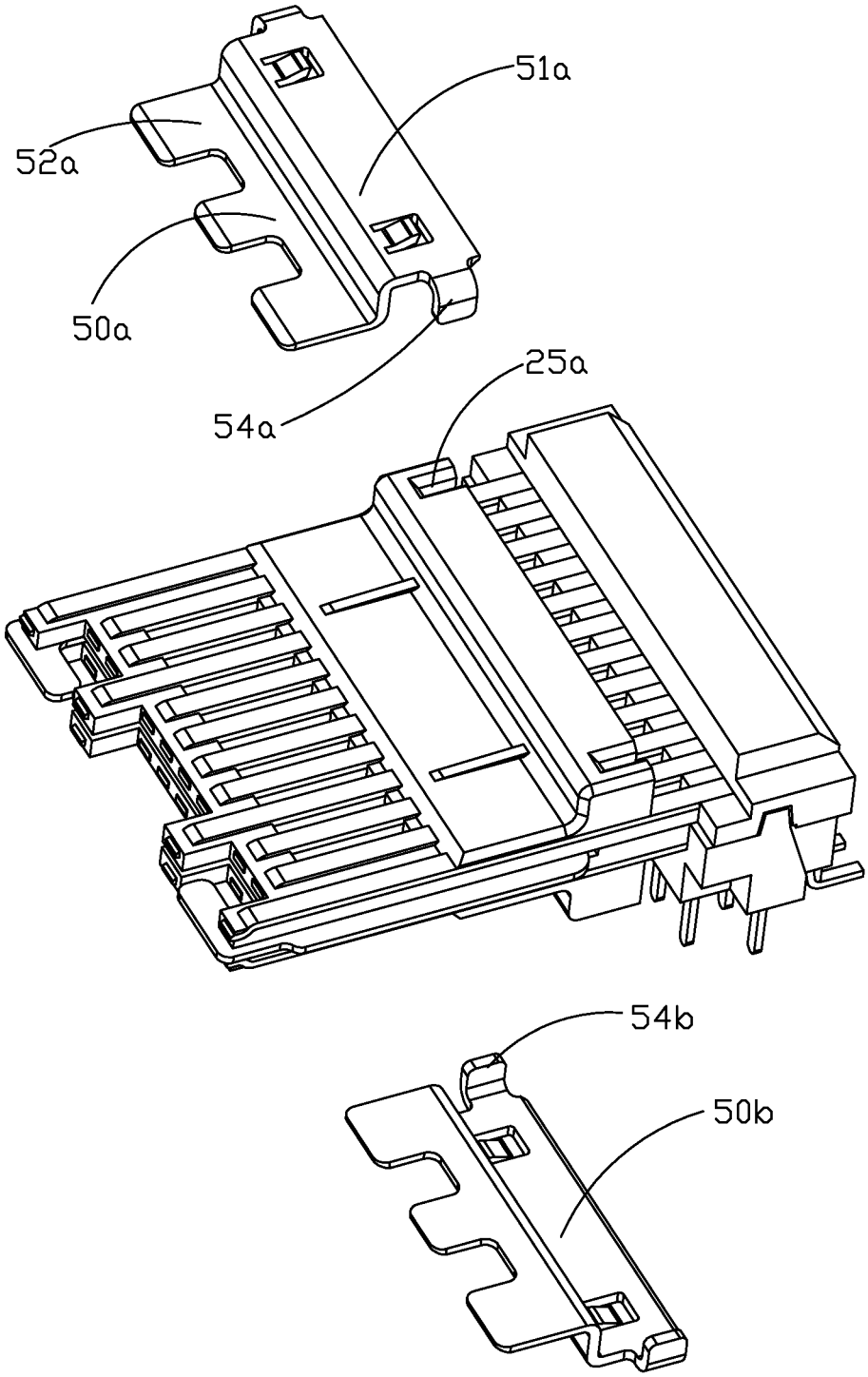
FIG. 8 is an exploded view of the electrical connector shown in FIG. 7.

Referring to FIGS. 7 and 8, another embodiment of the present disclosure is disclosed. The major differences between the first embodiment and the second embodiment are the detailed structure of the inner shell 50, the way for fastening the inner shell to the insulative housing 20 and the way for connecting the inner shell 50 and the outer shell 10.

The inner shell 50 in the second embodiment includes a top shell 50*a* and a bottom shell 50*b* separately made from each other. The top shell 50*a* and the bottom shell 50*b* are attached to the top side and the bottom side of the insulative housing 20, respectively. The top shell 50*a* includes a pair of upper fixing legs 54*a* extending downwardly from lateral sides thereof. The bottom shell 50*b* includes a pair of lower fixing legs 54*b* extending upwardly from lateral sides thereof. The insulative housing 20 includes a pair of upper slots 25*a* for receiving the upper fixing legs Ma and a pair of lower slots (not shown) for receiving the lower fixing legs 54*b*. The upper slots 25*a* and the lower slots are symmetrical with each other.

The connecting member 60 includes a plurality of elastic tabs 63 formed on the inner shell 50. The elastic tabs 63 are engaging against the outer shell 10 in order to achieve mechanical contact. It is understandable that the elastic tabs 63 can also be formed on the outer shell 10.

Figure 9:
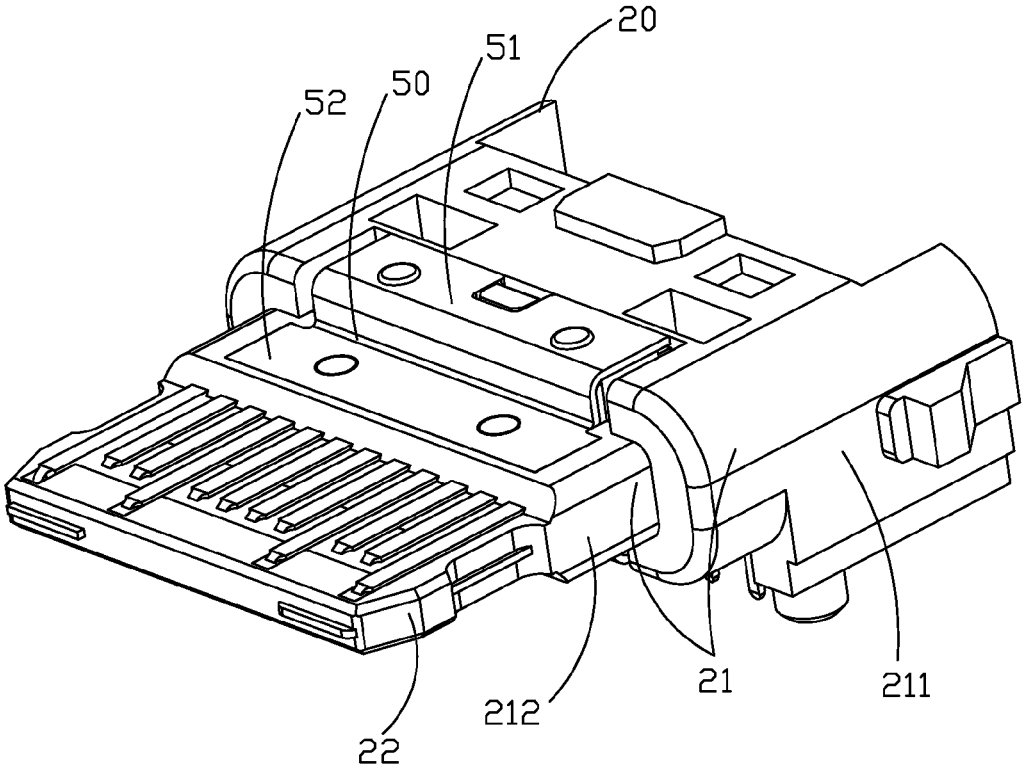
FIG. 9 is a perspective view of an electrical connector in accordance with a third embodiment of the present disclosure with an outer shell removed therefrom.
Figure 10:
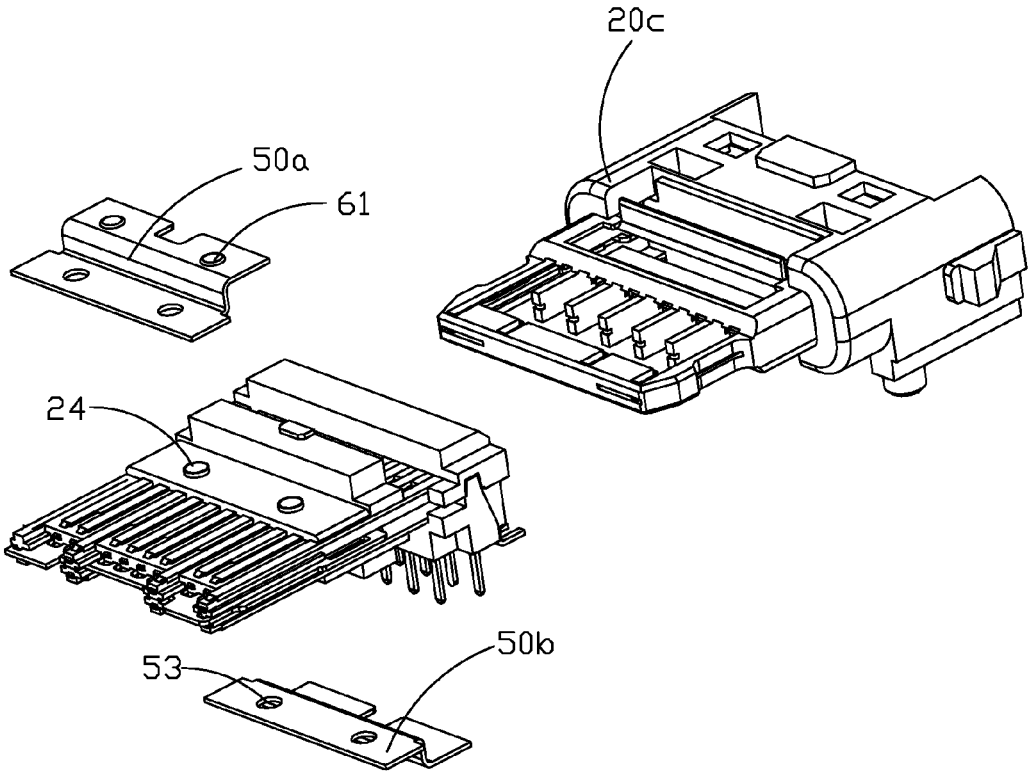
FIG. 10 is an exploded view of the electrical connector shown in FIG. 9.

Referring to FIGS. 9 and 10, another embodiment of the present disclosure is disclosed. The major difference between the first embodiment and the third embodiment is that the top sidewalls 54 of the top shell 50*a* and the bottom sidewalls 55 of the bottom shell 50*b* are removed. In positioning, the cylinder fixing protrusions 24 are received in the fixing openings 53 in order that the inner shell 50 and the insulative housing 20 can be combined together. After that, the outer insulative housing 20*c* is inject-molded on the upper insulative housing 20*a* and the lower insulative housing 20*b*.

Comparing with prior arts, the present discloses are provided with the inner shell 50 which can not only help to improve the strength of the tongue portion 22, but also improve shielding effect in contact with the grounding plate 40 and the outer shell 10. As a result, the signal transmission quality can be greatly improved. Besides, with the top shell 50*a* and the bottom shell 50*b* separately made, it is also beneficial to simplify the manufacture.

It is to be understood, however, that even though numerous characteristics and advantages of preferred and exemplary embodiments have been set out in the foregoing description, together with details of the structures and functions of the embodiments, the disclosure is illustrative only; and that changes may be made in detail within the principles of present disclosure to the full extent indicated by the broadest general meaning of the terms in which the appended claims are expressed.

What is claimed is:

1. An electrical connector comprising:

an insulative housing comprising a base and a tongue portion protruding from the base, the tongue portion comprising a top surface and a bottom surface opposite to the top surface;

a plurality of contacts retained in the insulative housing and comprising a plurality of flat contacting portions, the contacting portions being exposed on the top surface and the bottom surface, respectively;

a metallic outer shell enclosing the insulative housing; and a metallic inner shell positioned between the metallic outer shell and the insulative housing, the metallic inner shell comprising at least two pieces which are separately made, the at least two pieces being fixed to the insulative housing.

2. The electrical connector as claimed in claim 1, wherein the metallic inner shell comprises a top shell and a bottom shell, the top shell and the bottom shell being separately made, the top shell being attached to a top side of the insulative housing, and the bottom shell being attached to a bottom side of the insulative housing.

3. The electrical connector as claimed in claim 2, wherein the top shell comprises a pair of upper fixing legs extending downwardly from lateral sides thereof, the bottom shell comprises a pair of lower fixing legs extending upwardly from lateral sides thereof, the insulative housing comprises a pair of upper slots to receive the upper fixing legs and a pair of lower slots to receive the lower fixing legs.

4. The electrical connector as claimed in claim 2, wherein one of the top shell and the bottom shell comprises a hook, and a remaining one of the top shell and the bottom shell comprises a slot to receive the hook.

5. The electrical connector as claimed in claim 4, wherein the top shell comprises a pair of top sidewalls extending downwardly, the bottom shell comprises a pair of bottom sidewalls extending upwardly, one of the hook and the slot is formed on the top sidewall and a remaining one of the hook and the slot is formed on the bottom sidewall, the top sidewalls and the bottom sidewalls are jointed with each other so as to form a frame.

6. The electrical connector as claimed in claim 5, wherein the contacts comprise a plurality of upper contacts and a plurality of lower contacts, the electrical connector further comprising a metallic grounding plate between the upper contacts and the lower contacts.

7. The electrical connector as claimed in claim 6, wherein the metallic grounding plate is in mechanical contact with the metallic inner shell.

8. The electrical connector as claimed in claim 7, wherein the metallic grounding plate defines two slots through which the top sidewalls and the bottom sidewalls extend.

9. The electrical connector as claimed in claim 2, wherein each of the top shell and the bottom shell comprises an elastic tab abutting against the outer shell in order to achieve mechanical contact.

10. The electrical connector as claimed in claim 6, wherein the insulative housing comprises an upper insulative housing inject-molded with the upper contacts and the top shell, a lower insulative housing inject-molded with the lower contacts and the bottom shell, and an outer insulative housing inject-molded on the upper insulative housing and the lower insulative housing.

11. An electrical connector comprising:

an insulative housing comprising a base and a tongue portion protruding forwardly from the base, the tongue portion comprising a top surface and a bottom surface opposite to the top surface;

a plurality of contacts retained in the insulative housing, the contacts being divided into a plurality of upper contacts and a plurality of lower contacts, each contact comprising a contacting portion, the contacting portions of the upper contacts and the lower contacts being exposed on the top surface and the bottom surface of the tongue portion, respectively;

a metallic grounding plate positioned between the upper contacts and the lower contacts;

a metallic outer shell enclosing the insulative housing, the tongue portion being located at a center of the metallic outer shell along a vertical direction; and a metallic inner shell positioned between the metallic outer shell and the insulative housing, the metallic inner shell comprising at least two pieces which are separately made, the at least two pieces being fixed to the insulative housing.

12. The electrical connector as claimed in claim 11, wherein the metallic inner shell comprises a top shell and a bottom shell, the top shell and the bottom shell being separately made, the top shell being attached to a top side of the insulative housing, and the bottom shell being attached to a bottom side of the insulative housing.

13. The electrical connector as claimed in claim 11, wherein one of the metallic inner shell and the metallic outer shell comprises a protrusion, and a remaining one of the metallic inner shell and the metallic outer shell comprises a recess to receive the protrusion, the protrusion abutting against the recess to achieve mechanical contact.

14. The electrical connector as claimed in claim 12, wherein one of the top shell and the bottom shell comprises a hook, and a remaining one of the top shell and the bottom shell comprises a slot to receive the hook.

15. The electrical connector as claimed in claim 14, wherein the top shell comprises a pair of top sidewalls extending downwardly, the bottom shell comprises a pair of bottom sidewalls extending upwardly, one of the hook and the slot is formed on the top sidewall and a remaining one of the hook and the slot is formed on the bottom sidewall, the top sidewalls and the bottom sidewalls are jointed with each other so as to form a frame.

16. The electrical connector as claimed in claim 15, wherein the metallic grounding plate defines two slots through which the top sidewalls and the bottom sidewalls extend.

17. The electrical connector as claimed in claim 11, wherein the metallic grounding plate is insert molded in the insulative housing.

18. The electrical connector as claimed in claim 12, wherein the top shell comprises a pair of upper fixing legs extending downwardly from lateral sides thereof, the bottom shell comprises a pair of lower fixing legs extending upwardly from lateral sides thereof, the insulative housing comprises a pair of upper slots to receive the upper fixing legs and a pair of lower slots to receive the lower fixing legs.

19. The electrical connector as claimed in claim 12, wherein each of the top shell and the bottom shell comprises an elastic tab abutting against the outer shell in order to achieve mechanical contact.

20. The electrical connector as claimed in claim 11, wherein each contacting portion of the upper contacts comprises an upper protrusion bent downwardly from a front end thereof, each contacting portion of the lower contacts comprises a lower protrusion bent upwardly from a front end thereof, the upper protrusions and the lower protrusions are facing each other and are embedded in the tongue portion for fixation.

* * * * *